United States Patent [19]

Kenney et al.

[11] Patent Number: 4,680,237

[45] Date of Patent: Jul. 14, 1987

[54] COLORED FLOOR FINISH

[76] Inventors: Michael T. Kenney, 29055 S.W. Parkway, Space A.; Jeffrey S. Rhoades, 28900 S.W. Parkway, No. 14, both of Wilsonville, Oreg. 97070

[21] Appl. No.: 827,089

[22] Filed: Feb. 7, 1986

[51] Int. Cl.[4] ..... B32B 27/08; B05D 3/02

[52] U.S. Cl. ..... 428/520; 427/154; 427/155; 427/261; 427/282; 427/286; 427/407.1; 427/408

[58] Field of Search ..... 427/154, 155, 261, 282, 427/286, 407.1, 408; 428/520

[56] References Cited

U.S. PATENT DOCUMENTS

| | | | |
|---|---|---|---|
| 3,499,781 | 3/1970 | Krueckel | 427/407.1 |
| 3,855,170 | 12/1974 | Junkin et al. | 427/385.5 X |
| 4,046,726 | 9/1977 | Meiner et al. | 260/27 R |
| 4,070,510 | 1/1978 | Kahn | 427/385.5 |
| 4,071,645 | 1/1978 | Kahn | 427/340 |
| 4,151,138 | 4/1979 | Citrone et al. | 427/355 X |
| 4,169,088 | 9/1979 | Hansen | 427/140 X |
| 4,218,294 | 8/1980 | Brack | 427/154 X |
| 4,241,141 | 12/1980 | Dill | 428/500 |
| 4,391,858 | 7/1983 | Batzill | 427/407.1 |
| 4,529,632 | 7/1985 | Fujii et al. | 427/409 |

*Primary Examiner*—Thurman K. Page

*Attorney, Agent, or Firm*—Klarquist, Sparkman, Campbell, Leigh & Whinston

[57] ABSTRACT

A method of placing color indicia or tints on a porous surface includes the steps of forming a base layer on a surface, such as a floor, by applying a liquid layer of an unpigmented metal interlock acrylic finish to the surface, and allowing the base layer to dry. A pigmented layer of liquid metal interlock acrylic finish containing an acrylic polymer emulsion and pigment substance is then applied over the base layer in the form of an indicia, such as a decoration, advertisement, or pattern. After the pigmented layer has dried, a protective layer of liquid metal interlock acrylic finish is then applied over the pigmented layer and allowed to dry to protect the design, and the protective layer can be buffed to a shine. The method can be used to quickly and easily apply directional aids, advertisements, tints, or other colored indicia to a floor. Both the pigmented and unpigmented layers are readily removable with common detergents such as ammonia.

14 Claims, No Drawings

COLORED FLOOR FINISH

BACKGROUND OF THE INVENTION

1. Field of the Invention

This invention concerns a decorative floor covering and a method of applying it. The invention also relates to metal interlock acrylic finishes which are typically applied to floors.

2. General Discussion of the Background

Many commercial establishments, such as supermarkets, shopping centers, and department stores, have found that their products can be most effectively marketed by displaying numerous advertisements of products they sell. Some institutions also find it desirable to display directional aids in the form of arrows or color coded markings to provide directional assistance to their customers. Such advertisements, directional aids and other messages are typically displayed on signs attached to walls, ceilings, or shelves.

In spite of the excessive use of almost all available surfaces for displaying advertisements or directional aids, floors have not typically been used for this purpose. One of the reasons for such limited use of the floor is that customers' feet may become entangled in signs or tape which are placed on the floor. Another reason for this limited use is that the application of signs to a floor with adhesives often permanently mars the surface of the floor when the adhesive is removed. At best, signs attached with adhesive wear rapidly and must frequently be replaced, each time leaving a dirt-catching adhesive residue on the floor. Accordingly, there exists a need for a means of displaying indicia such as advertisements and directional aids on floors which will not entangle the feet of pedestrians, harm the surface of the floor, or leave an unsightly residue.

U.S. Pat. No. 3,499,781 of Krueckel discloses a method of applying multiple layered colored coatings onto metal, wood, plastic, or ceramic substrates. This method employs a polyester photopolymerizable resin (containing 25% acrylate) which is placed on the substrate. A decorative layer, containing an organic colorant such as an aniline dye mixed with an alkyd resin, is applied on top of the polyester photopolymerizable resin with a stencil. After the dyed layer has dried, a clear upper resin layer is then applied over the layer of dye as a protective finish. Such a method is not suitable for application to a floor since the resulting finish is designed to be quite permanent and requires heavy industrial solvents for removal that would seriously damage almost any floor. Another serious drawback to this method is that it employs an organic dye, which usually permanently colors any porous surface to which it is applied. Furthermore, the Krueckel resin requires ultraviolet radiation for curing. Such resins, which must be baked like car paint, are not suitable for application to floors.

U.S. Pat. Nos. 4,391,858 and 4,529,632 also both disclose permanent decorative coatings for automobiles which are unsuitable for removable application to a walking surface such as a floor.

Others have colored floors by adding organic dyes, such as aniline dyes, to carnauba-type floor waxes. These attempts have left the floors permanently tinted by the organic dye, and pigment migrates in soft waxes such as carnauba. Thus, such an approach is clearly an inadequate answer to the need for placing easily removable advertisements on a floor.

It is accordingly an object of this invention to provide a method in which a decorative, easily removable floor covering can be applied to the surface of a floor.

It is another object of the invention to provide such a method in which colored indicia placed on the floor are completely removable without any residual coloring remaining on the floor or other porous surface to which the indicia are applied.

Yet another object of the invention is to provide a method for temporarily changing the color of a floor by tinting it.

Even yet another object of the invention is to provide such a method which can be readily adapted to existing methods of floor treatment.

Finally, it is an object of the invention to provide a method which allows merchants to effectively use floor space to market their products with advertisements.

SUMMARY OF THE INVENTION

The aforementioned objects are achieved by providing a method of placing colored indicia or tints on a porous surface, such as a plastic or wooden floor. The method comprises the steps of first forming a base layer on the floor by applying a liquid layer of an unpigmented, metal interlock acrylic finish to the floor and allowing it to air dry. A pigmented layer is then formed over the base layer by applying a liquid layer of a pigmented, metal interlock acrylic finish over the base layer in the form of an advertisement, directional aid, or other indicia. The pigmented layer dries into a hardened, scuff-resistant film. The pigmented substance in the metal interlock acrylic finish is preferably comprised of calcined earth pigment.

In preferred embodiments, a protective liquid layer of metal interlock acrylic finish is applied over the pigmented layer by applying a film of unpigmented metal interlock acrylic finish over the pigmented layer. After air drying, the protective layer can then be buffed to a shine with high-speed buffers of the kind commonly used for floor polishing.

In yet other embodiments of the invention, the pigmented layer can be pigmented with watercolor. Such a pigment provides less vibrant colors than the calcined earth pigment. Watercolor pigmentation is accordingly more suited for temporary tinting of the entire surface of a floor.

Metal interlock acrylic floor finishes are typically formulated to be easily removable by a detergent such as ammonia and water. The advertisements or directional aids which are applied to a floor can therefore be periodically easily removed with an ammonia and water solution. Updated information or advertisements for new products can therefore easily replace the existing advertisements or information.

DETAILED DESCRIPTION

The following detailed description of a preferred embodiment is being given in accordance with requirements of law which specify that the inventor disclose and describe the best mode of making and using the invention known to him at the time an application is filed. This detailed description is not intended to limit the scope of protection under this patent, which scope is more appropriately construed in accordance with the appended claims.

This invention concerns the addition of pigments, such as calcined earth pigment and acrylic polymer emulsion to metal interlock acrylic floor finishes. Such floor finishes are well known in the art and are described in detail, for example, in U.S. Pat. No. 3,855,170, which is incorporated by reference. Other acrylic floor finishes of the kind contemplated by this invention are sold by Hillyard Chemical Company of St. Joseph, Mo. under the trademarks ODYSSEY, label information No. 530, DISCOVERY 2000, label information No. 524, or PRO-LINE ULTRATHANE floor polish, label information No. 3671. Similar products are also marketed by National Laboratories, Lehn & Fink Industrial Products Division of Sterling Drug, Inc., Montvale, N.J. under the trademarks SHYNEBRITE, FINISHING TOUCH, METALIST, and METALIST 20. Such floor finishes are liquid substances which are formulated to be air dryable, ammonia removable, and unpigmented. By air dryable, it is meant that no radiation source, other than ambient heat and light, is required to cure the finish.

Metal interlock acrylic floor finishes, such as that described in U.S. Pat. No. 3,855,170, are commonly applied to surfaces such as floors to provide a high gloss, scuff resistant finish. These finishes are typically applied by pouring the liquid floor finish onto a floor, spreading the liquid evenly across the surface of the floor with a sponge, mop, or roller, and allowing it to air dry. A clear hardened finish will remain on the floor until it is removed with common detergents, such as a mixture of ammonia and water.

Acrylic artists' paints of the kind used in this invention are sold by Permanent Pigment, Inc., a division of Binney & Smith, Inc., Cincinnati, Ohio 45212 under the trademark LIQUITEX.

Description of the Starting Materials

The novel pigmented floor finishes of the present invention can be formulated by mixing acrylic artists' paint from a tube into liquid metal interlock acrylic floor finish. In preferred embodiments, six ounces of calcined earth pigment in an acrylic polymer emulsion is squeezed from a tube into a gallon of the acrylic finish. The relative amounts of acrylic paint and liquid finish can be varied depending on the ultimate color intensity desired, greater quantities of paint yielding more vibrant colors in the applied floor finish. It is preferable that no more than 25 to 50% of the resulting paint and floor finish mixture be comprised of paint, since beyond that limit the mixture will begin to assume the properties of the paint, e.g., reduced durability, crusting, and long-drying time, instead of the floor finish. Such a result is undesirable since it is an attribute of the present invention that it has the coloration of the paint with the properties of the floor finish. There is no critical cutoff point known to the inventor beyond which the properties of the paint predominate.

The mixture of pigment and floor finish prepared with acrylic artists' paint produces vibrant colors which are especially suitable for placing written messages or advertisments on a floor. It may also be desirable, however, to merely temporarily tint the entire surface of a floor. Less vibrant colors will be desired for such a purpose, and they can be obtained by mixing about one-half pound of solid watercolor paint into a gallon of liquid acrylic floor finish. The quantity of watercolor used will depend on the intensity of the tint desired.

Once the acrylic paint or watercolor is added to the liquid floor finish, the mixture is thoroughly agitated until an homogenous mixture is obtained.

Description of the Method of Applying Advertisments and Other Indicia to a Floor In accord with the present invention, colored indicia, such as advertisements or directional aids, are placed on a porous surface such as a plastic or wooden floor. The method comprises the steps of first forming a base layer on the floor by applying a liquid layer of an air dryable, ammonia removable, unpigmented metal interlock liquid acrylic finish to the surface of a foor. The liquid layer is spread evenly over the floor with a sponge, brush, roller, or mop. The base layer is allowed to dry for thirty minutes to an hour, as is known in the art. A pigmented layer is then formed on top of the base layer by applying a liquid layer of pigmented, metal interlock, liquid acrylic finish in a pattern over the first layer. The pigmented layer can be applied with a sponge, brush, roller, sprayer, or any other tool that is normally used to apply acrylic paint to a surface. Stencils can be used to apply the pigmented layer if it is desired to apply the paint in the form of letters or other designs. After the pigmented layer has dried, a protective layer is then formed over the pigmented layer by applying a liquid layer of an unpigmented metal interlock acrylic finish over the pigmented layer, allowing it to dry, and then buffing the protective layer to a shine.

In other embodiments of the invention, a base layer and pigmented layer alone can be used. It is preferable, however, to apply a protective layer over the pigmented layer so that a higher buff shine can be achieved. The protective layer also helps to ensure that the advertisement or other decorative indicia on the floor will not be as easily scuffed, marred, or chipped away by pedestrian traffic.

When one desires to remove the advertisement from the floor, a conventional ammonia and water solution is applied to the floor, and all layers of the acrylic floor finish are quickly and easily removed from the surface of the floor. Another advertisement or decorative floor covering can then be applied to the floor surface to replace the original pattern. The surface of the floor is therefore readily adapted to changing marketing needs.

Method of Tinting Floors

The foregoing method can also be adapted to tinting a floor to temporarily change the color of its entire surface in a manner that is aesthetically pleasing. Since pigmented polymer emulsions are usually characterized by quite vibrant colors, it has been found that tinting is more aesthetically achieved by using the watercolor and acrylic floor finish mixture described as a starting material. A pigmented layer containing the watercolor pigment is then applied with a mop over a dried base layer, and a protective layer of liquid acrylic floor finish is in turn applied over the pigmented layer after the pigmented layer has dried. Once the protective layer dries, it is buffed to a high shine. The floor is thereby tinted a desired color until the acrylic floor finishes are removed with a water and ammonia solution.

The present method of applying colored indicia or tints can be used on any porous surface such as a wooden or plastic floor without risk that the surface will be permanently stained. The method is especially designed for temporary application of advertisements, written messages, and directional aids to floors.

Having illustrated and described the principles of the invention in a preferred embodiment, it should be apparent to those skilled in the art that the invention can be modified in arrangement and detail without departing from such principles. We claim all modifications coming within the spirit and scope of the following claims.

We claim:

1. A method of placing colored indicia or tints on a porous surface, the method comprising the steps of:

forming a base layer by applying an unpigmented metal interlock acrylic finish to said surface; and forming a pigmented layer by applying a pigmented metal interlock acrylic finish over said base layer, said pigmented finish containing an effective amount up to 50% of a paint comprised of a calcined earth pigment in an acrylic polymer emulsion.

2. The method of claim 1 further comprising the step of forming a protective layer by applying unpigmented metal interlock acrylic finish over said pigmented layer.

3. The method of claim 1 wherein said pigmented finish is applied in a pattern to said base layer.

4. The method of claim 1 wherein said porous surface is a floor.

5. The method of claim 4 wherein said protective layer is buffed to a shine.

6. The method of claim 1 wherein said base and pigmented layers are formulated to be removable by ammonia.

7. The method of claim 1 wherein said metal interlock acrylic finishes are formulated to be air dryable.

8. A decorative floor covering comprising:

a base layer comprising an unpigmented, metal interlock acrylic finish on said floor; and a pigmented layer comprising a pigmented metal interlock acrylic finish over said base layer, said pigmented finish containing an effective amount up to 50% of a paint comprised of a calcined earth pigment in an acrylic polymer emulsion.

9. The decorative floor covering of claim 8 further comprising a protective coat of unpigmented, metal interlock acrylic finish over said pigmented layer.

10. The decorative floor covering of claim 9 wherein said pigmented layer is in the form of a pattern.

11. The method of claim 1 further comprising:

after forming said base layer, allowing it to dry;

then forming said pigmented layer, and allowing said pigmented layer to dry;

then forming a protective layer by applying a liquid layer of an unpigmented metal interlock acrylic finish over said pigmented layer, and allowing said protective layer to dry; and then buffing said protective layer to a shine.

12. A method of placing colored indicia or tints on a porous surface, the method comprising the steps of:

forming an unpigmented base layer by applying an unpigmented metal interlock acrylic finish to said surface; and forming a pigmented layer by applying a pigmented metal interlock acrylic finish over said base layer, said pigmented finish containing an effective amount up to 50% of a pigment substance.

13. The method of claim 12 wherein said pigment substance is watercolor.

14. The method of claim 12 wherein said pigment substance is calcined earth pigment is an acrylic polymer emulsion.

* * * * *

UNITED STATES PATENT AND TRADEMARK OFFICE

CERTIFICATE OF CORRECTION

PATENT NO. : 4,680,237

DATED : July 14, 1987

INVENTOR(S) : Michael T. Kenney, Jeffrey S. Rhoades

It is certified that error appears in the above-identified patent and that said Letters Patent is hereby corrected as shown below:

Column 6, line 34, change "is" [second occurrence] to --in--.

Signed and Sealed this

Tenth Day of November, 1987

*Attest:*

DONALD J. QUIGG

*Attesting Officer*

*Commissioner of Patents and Trademarks*